US011632998B2

(12) United States Patent
Eldridge et al.

(10) Patent No.: US 11,632,998 B2
(45) Date of Patent: Apr. 25, 2023

(54) ATTACHMENT FOR CAPS

(71) Applicant: Snaps Ventures Inc., Jupiter, FL (US)

(72) Inventors: Matthew Ryan Eldridge, Jupiter, FL (US); Sydney Diane Bakich, Jupiter, FL (US)

(73) Assignee: Snaps Ventures Inc., Jupiter, FL (US)

( * ) Notice: Subject to any disclaimer, the term of this patent is extended or adjusted under 35 U.S.C. 154(b) by 0 days.

(21) Appl. No.: 17/130,499

(22) Filed: Dec. 22, 2020

(65) Prior Publication Data

US 2021/0106088 A1 Apr. 15, 2021

Related U.S. Application Data

(63) Continuation of application No. 16/473,617, filed as application No. PCT/US2017/033712 on May 21, 2017, now Pat. No. 10,952,486.

(51) Int. Cl.
*G09F 3/02* (2006.01)
*A42B 1/248* (2021.01)
(Continued)

(52) U.S. Cl.
CPC ..... *A42B 1/248* (2013.01); *G09F 3/02* (2013.01); *G09F 3/16* (2013.01); *G09F 21/02* (2013.01);
(Continued)

(58) Field of Classification Search
CPC ... A42B 3/00; G09F 3/16; G09F 21/02; G09F 21/023; G09F 2003/0282
See application file for complete search history.

(56) References Cited

U.S. PATENT DOCUMENTS 1,053,974 A 2/1913 Cohen
1,236,654 A 8/1917 Baltzley
(Continued)

FOREIGN PATENT DOCUMENTS

DE 296 09 123 U1 8/1996
JP D1606101 S 6/2018
(Continued)

OTHER PUBLICATIONS

International Search Report and Written Opinion for International Application No. PCT/US2017/033712, dated Aug. 23, 2017.
(Continued)

*Primary Examiner* — Gary C Hoge
(74) *Attorney, Agent, or Firm* — Wolf, Greenfield & Sacks, P.C.

(57) ABSTRACT

An attachment for mounting on straps extending between a rear opening of a cap. The attachment comprises a first panel having an outer and inner surface, and a clip section comprising a connector and a second panel having an outer and inner surface. The panels are spaced such that the first and second panels face each other and are substantially parallel to each other. The connector connects the first panel and the second panel at the top edge of the first panel and defines a gap between the panels. The gap is sufficient to permit the strap or straps to nest within, such that when the strap or straps are nested, the first and second panels lie on opposite sides of the strap or straps. The first and second panels contain ridges along their edges that engage the strap or straps and keep the cap attachment in place. The outer surfaces of the panels display advertising indicia or decoration and have a cushioned area.

13 Claims, 7 Drawing Sheets

(51) Int. Cl.
*G09F 3/16* (2006.01)
*G09F 21/02* (2006.01)

(52) U.S. Cl.
CPC .... *G09F 21/023* (2020.05); *G09F 2003/0282* (2013.01)

(56) References Cited

U.S. PATENT DOCUMENTS 2,181,446 A 11/1939 Ames
2,737,220 A 3/1956 Hoff
D254,845 S 4/1980 Young
4,776,043 A 10/1988 Coleman
5,003,640 A * 4/1991 Pizzacar ..... A42B 1/248 2/181.4
D326,932 S 6/1992 Millar
5,165,190 A 11/1992 Smyth
D341,712 S 11/1993 Fulcher
D343,372 S 1/1994 Ferré
5,287,559 A * 2/1994 Christiansen ..... A42B 1/248 2/181
5,315,714 A * 5/1994 Peters ..... A42B 1/22 2/181.4
5,418,981 A * 5/1995 Miner ..... A42B 1/248 2/181
5,428,844 A * 7/1995 Dougherty ..... A42B 1/248 2/181
5,442,817 A * 8/1995 Miner ..... A42B 1/248 2/181.4
5,499,402 A * 3/1996 Rose ..... A42B 1/248 2/181.4
5,517,695 A * 5/1996 Murray ..... A42B 1/248 2/181.4
5,519,892 A * 5/1996 Pizzacar ..... A42B 1/248 2/181
5,533,213 A * 7/1996 Reiner ..... A42B 1/248 2/195.2
5,546,605 A * 8/1996 Mallardi ..... A42B 1/22 2/181
D373,454 S 9/1996 Ramirez
D375,827 S 11/1996 Will
5,600,855 A * 2/1997 Ramirez ..... A42B 1/22 2/181.4
5,632,047 A * 5/1997 Van Den Heuvel ... A42B 1/248 2/171.4
5,687,425 A * 11/1997 Blosser ..... A42B 1/22 2/181.4
5,857,220 A * 1/1999 Erny ..... A45C 13/08 2/244
5,918,316 A * 7/1999 Nathanson ..... G09F 21/02 2/209.13
D412,937 S * 8/1999 Franklin ..... D20/27
5,997,662 A 12/1999 Norio
6,006,362 A * 12/1999 Walsh ..... A42B 1/248 2/181
6,021,525 A 2/2000 Mertins
D431,709 S * 10/2000 Cupps ..... D2/891
6,185,750 B1 2/2001 Dumas
6,279,168 B1 * 8/2001 Bean ..... A42B 1/248 2/195.1
6,484,322 B2 * 11/2002 Christian ..... A42B 1/24 2/209.13
D486,862 S 2/2004 Coe
6,694,526 B1 2/2004 Tate
6,729,058 B2 5/2004 Ferguson
D497,858 S 11/2004 Fabian
6,871,486 B2 3/2005 Moehnke et al.
D579,194 S 10/2008 Caylor
D591,934 S 5/2009 Gore
D601,792 S 10/2009 Kennedy
D605,381 S * 12/2009 Mastrantonio ..... D2/891
D613,638 S 4/2010 Jorst et al.
D627,146 S 11/2010 Kantor et al.
D635,336 S 4/2011 Alger
D637,106 S 5/2011 Babyak
D638,964 S 5/2011 Cappuccio
D645,211 S 9/2011 Hill
D645,231 S 9/2011 Perry
D667,212 S 9/2012 Reilly
D682,665 S * 5/2013 Meyer ..... G09F 3/06 D8/395
8,573,773 B1 11/2013 Acosta
D695,454 S 12/2013 Moore
D724,479 S 3/2015 Cerrato
D724,487 S 3/2015 Dighton et al.
D729,502 S 5/2015 Aldridge
D737,564 S 9/2015 Hamilton et al.
9,198,483 B2 12/2015 Adams et al.
D757,402 S 5/2016 White
D757,403 S 5/2016 Skinner
D761,001 S 7/2016 Kouns et al.
D770,733 S 11/2016 Hwang
D771,914 S 11/2016 Cho
D774,283 S 12/2016 Rollins
D778,767 S 2/2017 Nicolas
D793,675 S 8/2017 Gates
D801,644 S 11/2017 Zenoff
D838,941 S 1/2019 Leatherman
D863,441 S 10/2019 Hwang et al.
D865,334 S 11/2019 Kang
D905,382 S 12/2020 Jackson
D931,579 S 9/2021 Eldridge et al.
2002/0042941 A1 4/2002 Grundy
2002/0108165 A1 8/2002 Porter et al.
2004/0064871 A1 4/2004 Schlapkohl
2008/0104801 A1 5/2008 Yeh
2008/0109940 A1 * 5/2008 Van Den Heuvel ... A42B 1/248 2/209.12
2008/0134414 A1 6/2008 Cho
2010/0122399 A1 5/2010 Odom
2010/0325780 A1 12/2010 Scanlan
2013/0111650 A1 5/2013 Hong
2014/0315661 A1 10/2014 Brown et al.
2017/0027250 A1 2/2017 Paquette
2019/0142096 A1 5/2019 Skinner
2019/0313724 A1 10/2019 Jackson
2020/0146383 A1 5/2020 Eldridge et al.

FOREIGN PATENT DOCUMENTS

JP D1623350 S 1/2019
WO WO DM/093473 4/2017
WO WO DM/099239 1/2018
WO WO 2018/217186 A1 11/2018

OTHER PUBLICATIONS

International Preliminary Report on Patentability for International Application No. PCT/US2017/033712, dated Dec. 5, 2019.
Extended European Search Report for European Application No. 17910920.2, dated Nov. 30, 2020.

* cited by examiner

ATTACHMENT FOR CAPS

CROSS REFERENCE TO RELATED APPLICATIONS

This application claims the benefit under 35 U.S.C. § 120 and is a continuation of U.S. application Ser. No. 16/473,617, filed Jun. 25, 2019 and entitled "ATTACHMENT FOR CAPS", which is a National Stage filing under 35 U.S.C. § 371 of International Application No. PCT/US2017/033712, filed May 21, 2017 and entitled "SNAP ATTACHMENT FOR CAPS", the entire contents of each of which are incorporated herein by reference.

FIELD OF THE INVENTION

The present invention relates generally to caps such as baseball caps. More particularly, the invention relates to an improved attachment for such caps that bears advertising or decoration.

BACKGROUND

Baseball-style caps which have an opening in the back with a band or one or two straps going across the opening are well known. Caps may be adjustable in size, for example, by using adjustable straps or an elastic band. These caps often display various logos on the front of the cap. Attachments that attach to the band or straps of these caps and display various advertising indicia are also known, such as those disclosed in U.S. Pat. Nos. 5,499,402; 5,533,213; 5,003,640; 5,600,855; and U.S. Patent No. D412,937. Given the popularity of people wearing their caps backwards, attachments that display the advertising indicia at the back or rear of the cap are also known, such as those disclosed in U.S. Pat. No. 5,418,981. These products are able to display advertising on the caps but are not comfortable to wear, especially when the cap is worn backwards and the attachment touches the forehead of the person causing irritation. Additionally, these attachments do not sit well on the cap strap or straps when the cap size gets adjusted thereby limiting their use to certain caps.

Accordingly, there is a need for an improved cap attachment that overcomes these drawbacks and is easy to attach, comfortable to wear, accommodates different cap sizes and is also more attractive or stylish.

SUMMARY OF THE INVENTION

The present invention addresses these shortcomings by providing an improved cap attachment that is simple and easy to use. In an embodiment, the improved cap attachment comprises a first panel and a clip section comprising a second panel and a connector connecting the two panels. The first panel has an inner surface that is closer to the cap or user's head and an outer surface that bears advertising indicia. The second shorter panel has an outer surface that is in contact with the hair/skin of the person using the cap and an inner surface in contact with the one or two cap straps. The inner surfaces of the two panels face each other. The connector connects the two panels and creates a gap through which the cap straps or band passes. The attachment may snap on to the band or straps. The panels contain ridges along their edges to engage the band or straps and keep the attachment in place. The outer surface of the second panel has a cushioned or padded area such that when the user wears the cap backwards, the cushioned area touches the forehead of the person. The shorter second panel allows more room for cap size adjustment without compromising the position of the longer first panel on the band or straps. The first and second panels are substantially parallel and slightly curved to conform to the shape of the rear of the head. In another embodiment, the second panel that is in contact with the head is curved and the first panel is flat. In an embodiment, the outer surface of the second panel may have an inset area for displaying additional branding and is surrounded by the padded area.

DETAILED DESCRIPTION OF THE INVENTION

The following detailed description and accompanying drawings disclose various aspects and/or embodiments of the invention. Well-known elements of the disclosure are not described in detail or have been omitted so as not to obscure the relevant details of the disclosure.

Figure 5:
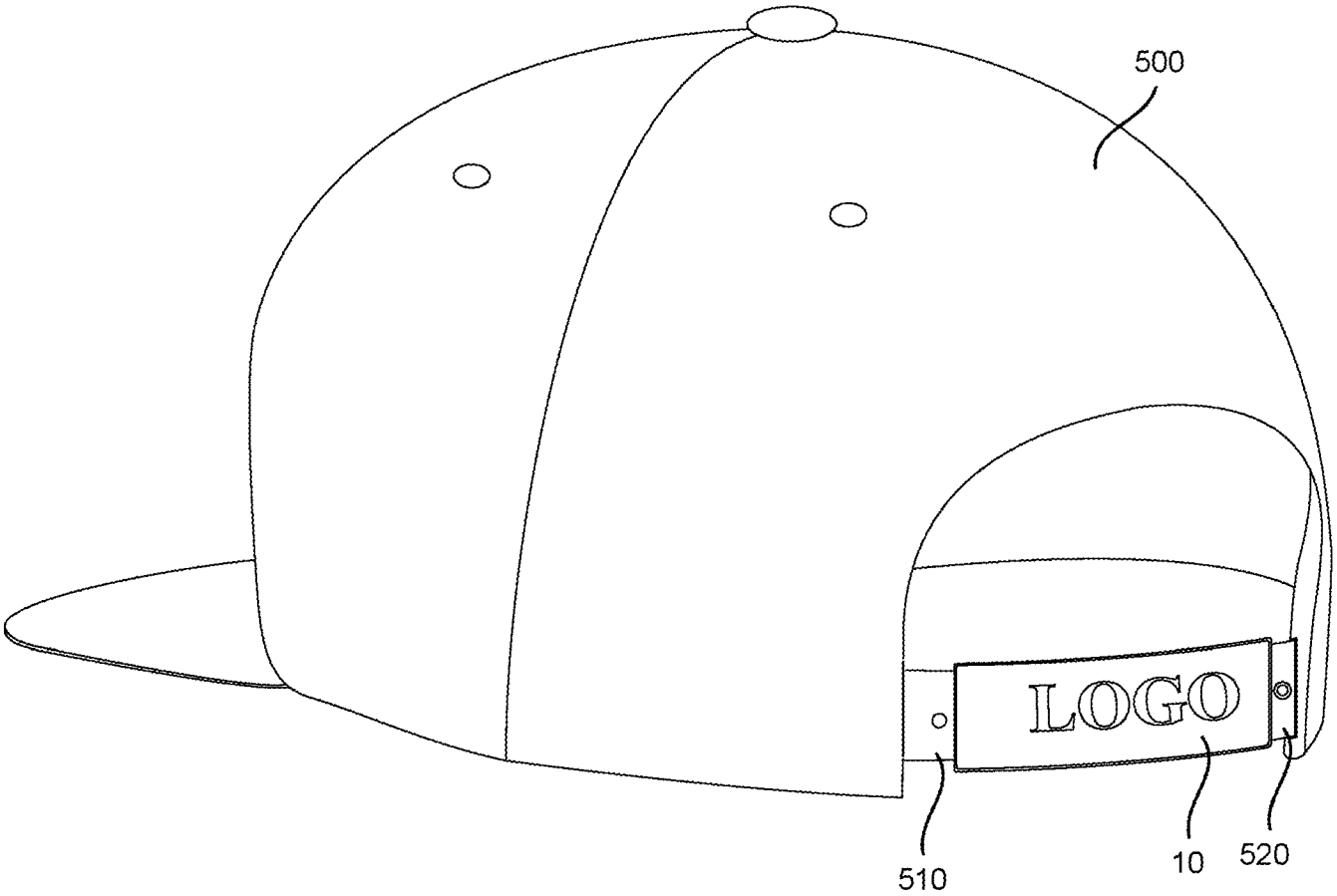
FIG. 5 shows a perspective view of the cap attachment of FIG. 1 applied to a conventional cap, in accordance with one embodiment of the invention.
Figure 6:
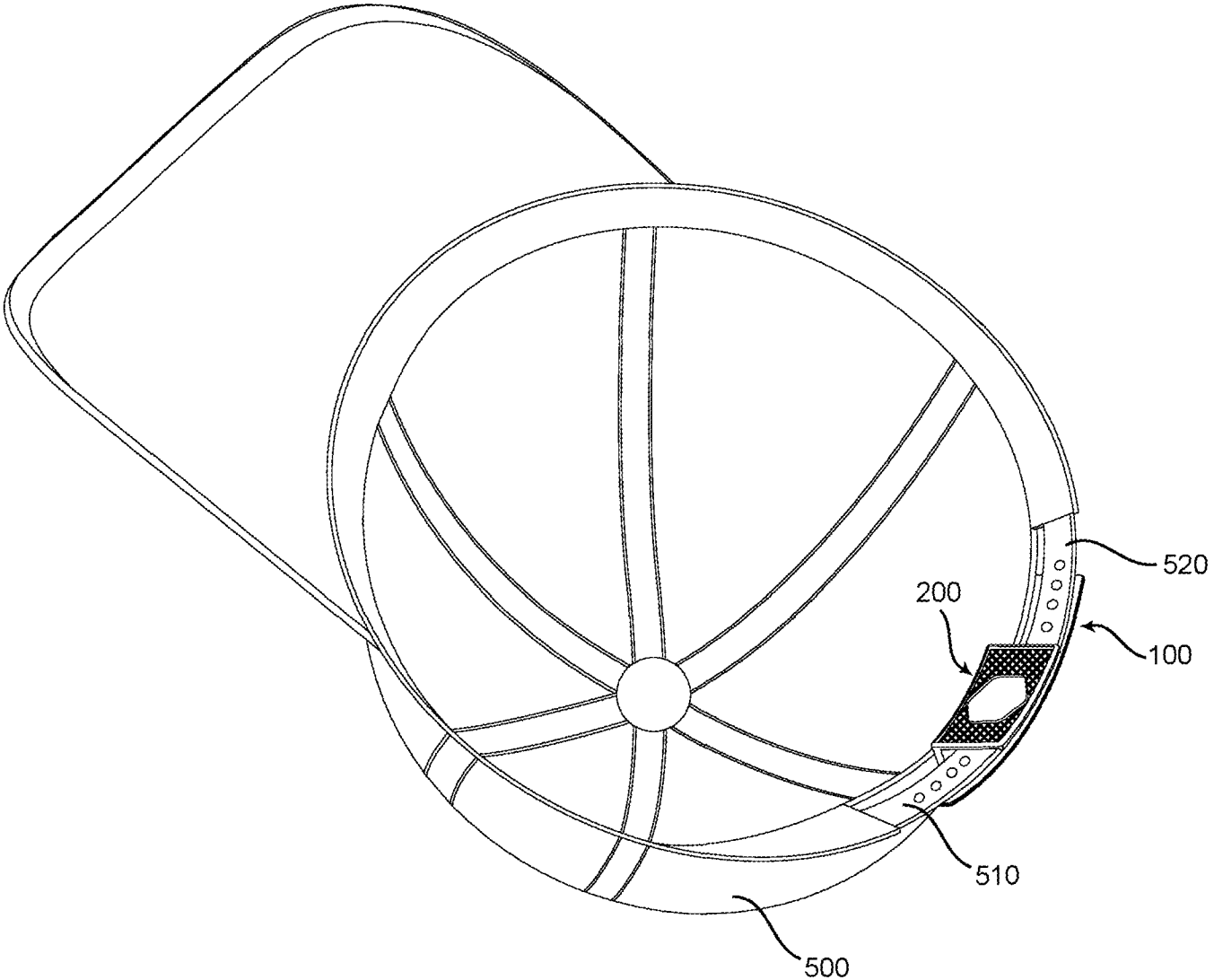
FIG. 6 shows another perspective view of the cap attachment of FIG. 1 applied to the conventional cap and revealing the rear side, in accordance with one embodiment of the invention.

Conventional caps (headwear) often have an opening in the rear of the cap. A band typically extends horizontally across the opening and typically allows for adjustment of the cap size to fit heads of different users. For example, the band may be an elastic band. Alternately, the adjustment may be achieved by one or two straps with a connection method. For example, a pair of straps having holes and studs, VELCRO or other similar mechanism. Alternately, the cap may have a fixed strap or a combination of fixed strap and an elastic band etc. As used herein, "strap" includes a band, belt and the like that extends horizontally across the opening in the rear of a cap. (FIGS. 5-6, item 510).

Figure 1:
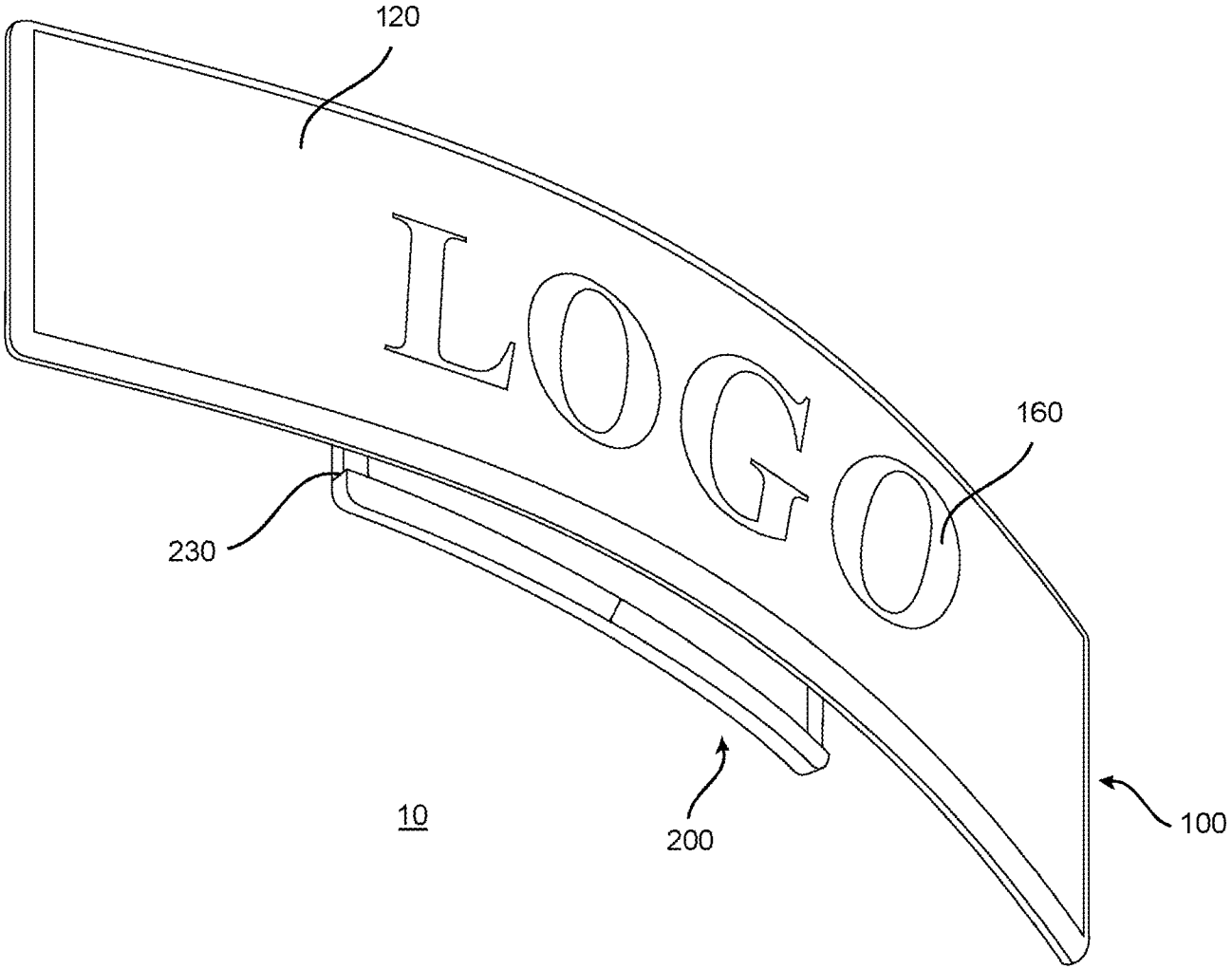
FIG. 1 is a perspective view of the cap attachment showing the front side of the attachment with the first panel, in accordance with one embodiment of the invention.
Figure 2:
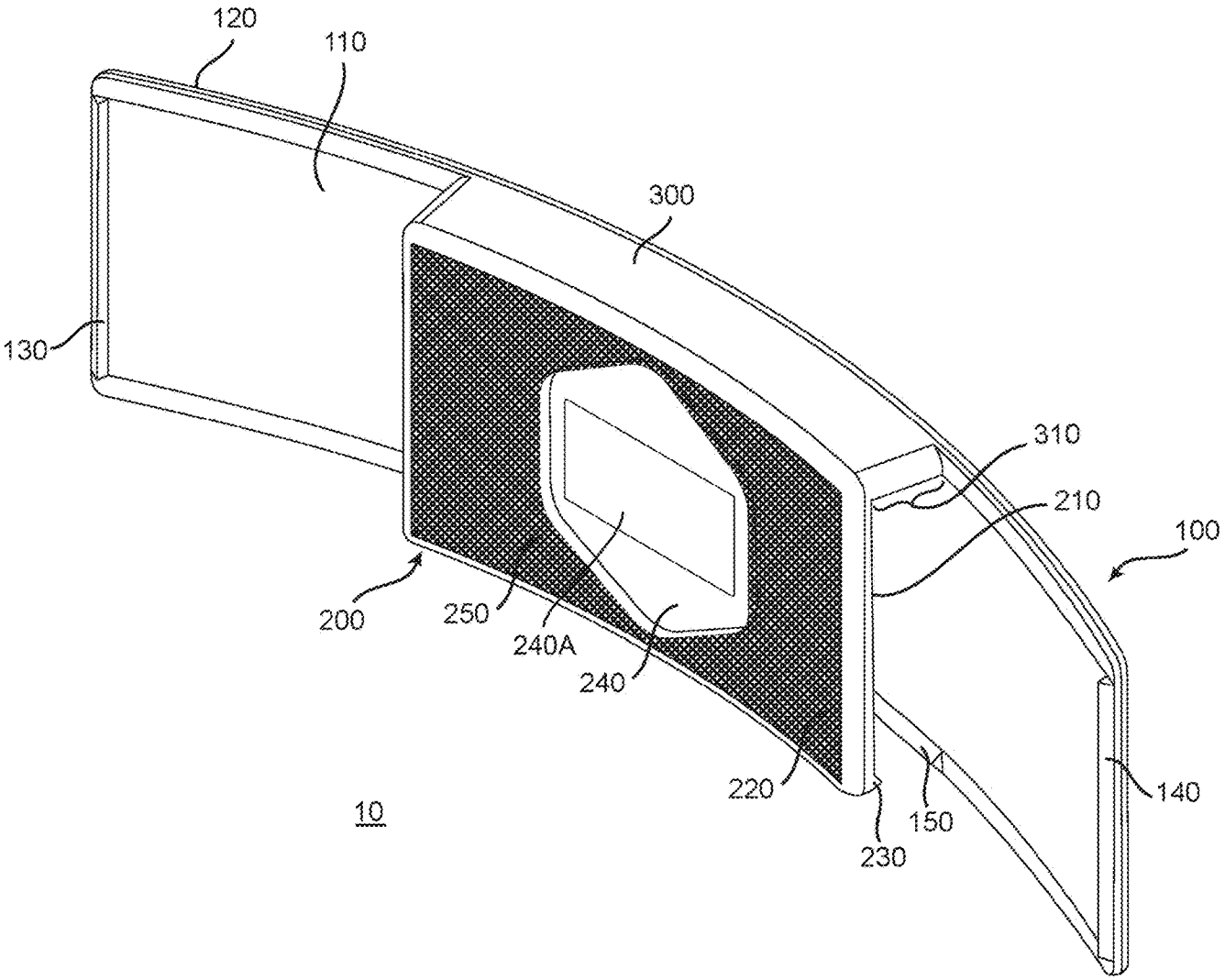
FIG. 2 is a perspective view of the cap attachment showing the rear side of the attachment with the second panel and the connector, in accordance with one embodiment of the invention.

With reference to FIGS. 1 and 2, an exemplary cap attachment 10 in accordance with one embodiment of the invention is disclosed. The cap attachment 10 comprises a first panel 100, a second panel 200 and a connector 300. The second panel 200 and the connector 300 (FIG. 2) comprise a clip section. The first panel 100 includes an inner surface 110 and an outer surface 120 that bears advertising indicia or decoration 160. The outer surface 120 is outward facing from the center of the cap attachment 10. The advertising indicia 160 may be, for example, a logo, an image, text, a combination thereof etc. Alternately or in addition, the outer surface 120 may bear a decoration such as art designs, encrusted diamonds, jewelry etc. The cap attachment 10 may serve an advertising or promotional purpose and/or as a fashion accessory the cap.

With reference to FIG. 2, the inner surface 110 of the first panel is shown. The inner surface 110 is inward facing from the center of the cap attachment 10. The inner surface 110 is closer to the user's head and in contact with the cap strap(s). The width of the first panel 100 is slightly larger than the width of the cap straps or band. The length of the first panel 100 is at least part way of the length of the cap strap or band. The first panel 100 may be curved so as to better align with the shape of the user's head. Alternately, the first panel 100 may be flat and not curved. The first and second panels may generally be rectangular in shape. Alternately, the first and/or second panels may be any other suitable shape, e.g., oval, a trapezoid, or a parallelogram.

The second panel 200 includes an inner surface 210 and an outer surface 220. The inner surface 210 is inward facing from the center of the cap attachment 10 and in contact with the cap strap or straps when the attachment is nested. The outer surface 220 is outward facing from the center of the cap attachment 10 and closer to the user's head. The outer surface 220 has an inset area 240. The inset area 240 may display different branding or advertising indicia 240A than the indicia displayed on the first panel. The inset area 240 is optional. The outside surface 220 may contain a soft or cushioned or padded area 250. The soft area 250 may cover the area surrounding the inset 240 or cover the entire outside surface 220. The width of the second panel 200 is about the same as the width of the first panel 100 and slightly larger than the width of the cap straps or band. The length of the second panel 200 is shorter than the length of the first panel 100. In one embodiment, the length of the second panel 200 is approximately half of the length of the first panel 100. The length of the second panel 200 is at least part way of the length of the cap strap or band. The second panel 200 is centered along the length of the first panel 100. The second panel 200 may be curved so as to better align with the shape of the user's head. The second panel 200 is substantially parallel to the first panel 100 and is spaced behind the first panel 100. The inner surfaces 110 and 210 face each other. The second panel 200 is connected to the first panel 100 at the top edge by the connector 300. The connector 300 defines a space 310 into which the cap strap or straps nest and fit in. When the attachment 10 is fitted or snapped over the strap(s), the first and second panels lie on opposite sides of the strap(s).

The inner surface 110 of the first panel includes one or more ridges along its edges that help engage or grip the cap strap or straps and keep the attachment 10 in place. In one embodiment, the inner surface 110 has a ridge 130 along the left side edge and a ridge 140 along the right side edge and a ridge 150 on the bottom edge. Ridges 130 and 140 extend along the entire left and right edges along the width of the attachment 10. Alternately, ridges 130 and 140 may be shorter. Ridges 130 and 140 may grip on the strap(s) or even the cap if the first panel 100 extends beyond the length of the strap(s). Ridge 150 extends at least along a portion of the bottom edge.

Figure 3:
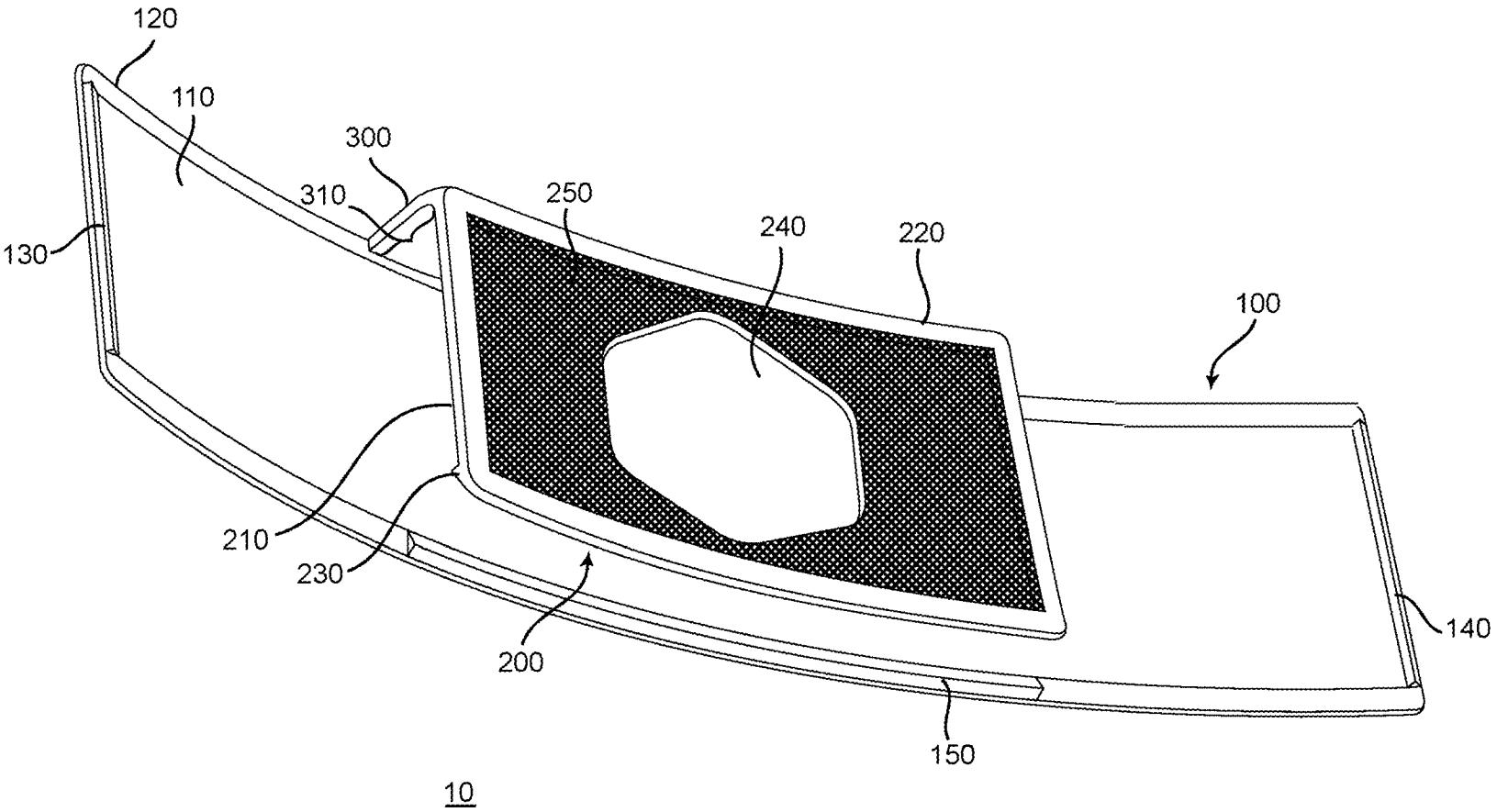
FIG. 3 is another perspective view of the cap attachment showing the rear side of the attachment with the second panel, in accordance with one embodiment of the invention.

As shown in FIG. 3, ridge 150 is substantially the same length as the length of the second panel 200. Alternately, ridge 150 may be longer. The inner surface 210 of the second panel similarly has a ridge 230 along the bottom edge to engage the cap strap or straps. Ridge 230 extends along the entire bottom length of the second panel. Alternately, ridge 230 may be shorter. A complete view of ridge 230 is shown in FIG. 1. The ridge 230 on the second panel and the ridge 150 on the first panel are opposite to each other.

Figure 4:
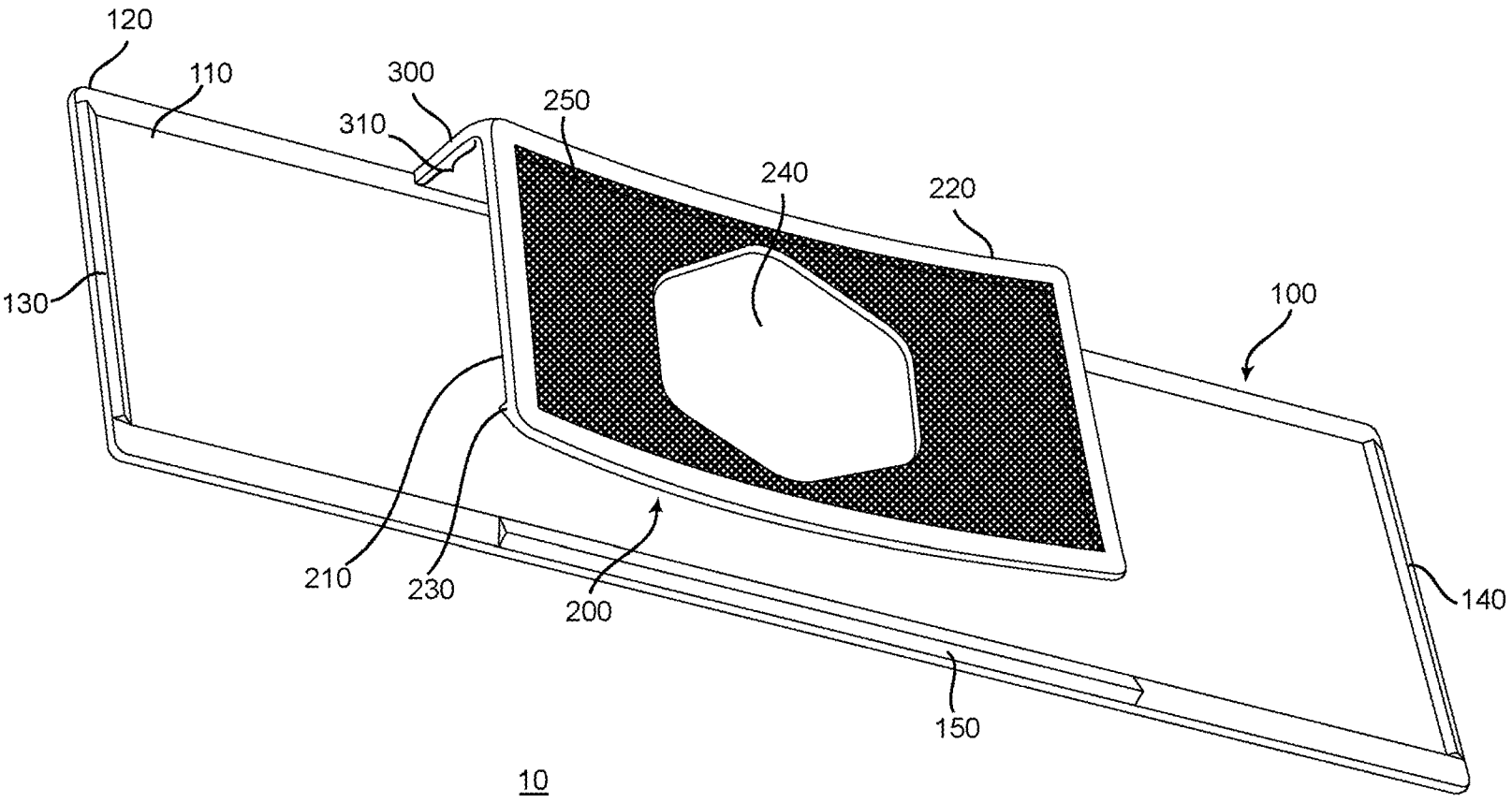
FIG. 4 is a perspective view of the cap attachment showing the rear side of the attachment, in accordance with another embodiment of the invention.

FIG. 4 shows another embodiment of the cap attachment 10. In this embodiment, the second panel 200 is curved so as to better align with the shape of the user's head. The first panel 100 bears the advertising indicia or decoration and is flat.

FIG. 5 shows the cap attachment 10 applied to a conventional cap such as a baseball cap 500. The cap 500 has two adjustable straps 510 and 520. The adjustment of the cap size is achieved by means of holes and studs on the straps. The clip section of the attachment 10 snaps over the straps such that the straps slide through the gap 310 (not shown) between the first and second panels and the two panels are on the opposite side of the straps. FIG. 6 shows the rear side of the cap attachment from inside the cap having the second panel 200. The ridges on the first and second panels engage or grip the straps and provide an easy and simple way to lock or keep the attachment 10 in place and prevent it from sliding back and forth and/or up and down on the straps. The ridges may be of any suitable shape or style to permit engagement with the strap(s), such as raised or recessed. Other mechanisms to keep the cap attachment 10 in place on the straps may also be used, e.g., loop and hook etc. The shorter length of the second panel 200 allows a wider adjustment of the cap size without affecting the position of the first panel 100 that bears the advertising indicia. For example, the longer first panel may extend beyond the straps 510 and 520 and the opening in the rear onto the cap if needed. A user may remove the cap attachment 10 from the cap by lifting the clip section to disengage the straps and/or sliding the straps out of the gap 310 between the first and second panels.

Figure 7:
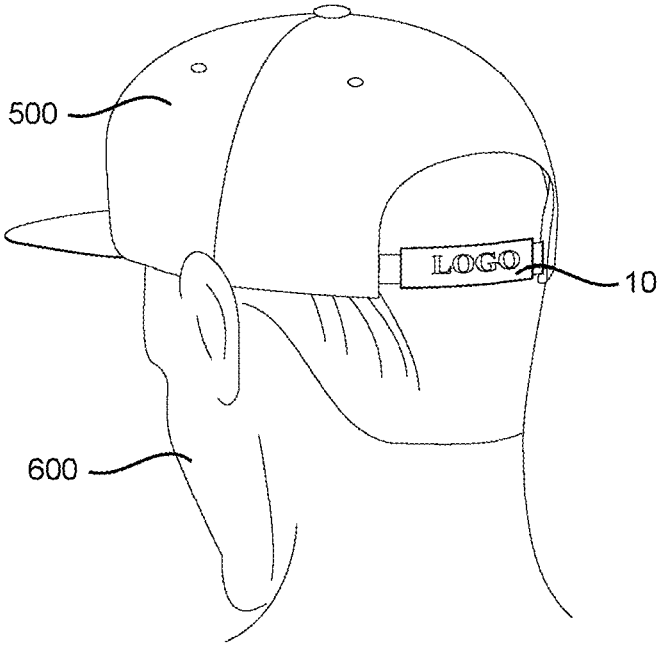
FIG. 7 shows a perspective view of a user wearing the conventional cap forwards with the cap attachment of FIG. 1 applied to the conventional cap and displaying advertising indicia, in accordance with one embodiment of the invention.
Figure 8:
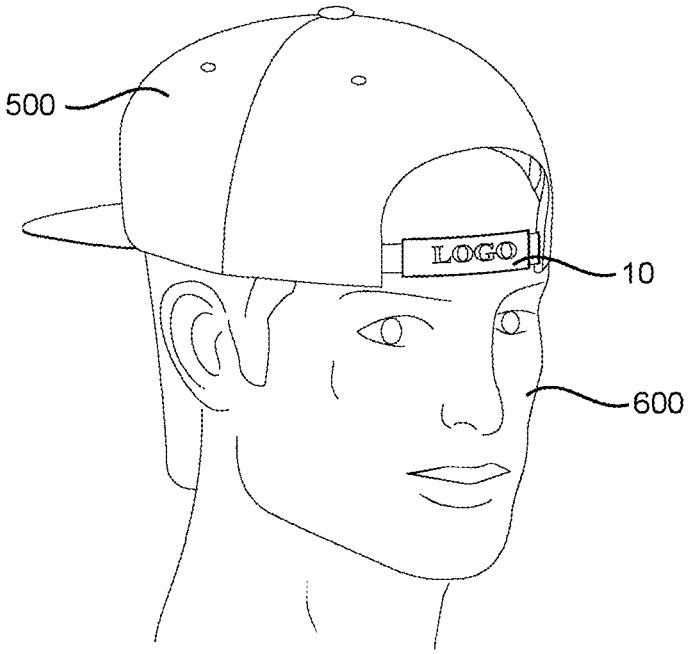
FIG. 8 shows a perspective view of a user wearing the conventional cap backwards with the cap attachment of FIG. 1 applied to the conventional cap and displaying advertising indicia, in accordance with one embodiment of the invention.

FIG. 7 shows the cap attachment 10 applied on the cap 500 and a user 600 wearing the cap in a conventional forward orientation. The cap may have VELCRO straps to allow size adjustment. The cap attachment 10 may be applied to any cap with an opening in the rear and a strap. The advertising indicia, such as a logo is displayed on the cap attachment positioned on the back of the user's head. When the cap is worn in this manner, the second panel is in contact with the user's hair on the head. FIG. 8 shows the cap attachment 10 applied on the cap when the user is wearing the cap backwards. In this orientation, the second panel is in contact with the user's forehead. The cushioning on the second panel increases the comfort of the user and may avoid irritation and absorb perspiration. The cushion area allows presenting a tactilely pleasant sensation to the skin or hair of the user.

The cap attachment 10 may be made of any suitable material such as plastic, carbon fiber, pewter, steel, copper, silver, gold, platinum, palladium, precious metals, brass, bronze, aluminum etc. The cap attachment 10 may be made by any suitable techniques such as casting, injection molding, 3D printing etc. The cushion area 250 may be made of any suitable soft and/or absorbent material such as foam, cotton, rayon, fiber etc.

It is to be understood that the above-described embodiments are only illustrative of the application of the principles of the present invention. The illustrative discussions above are not intended to be exhaustive or to limit the invention to the precise forms disclosed. Various modifications and alternative applications may be devised by those skilled in the art in view of the above teachings and without departing from the spirit and scope of the present invention and the following claims are intended to cover such modifications, applications, and embodiments.

The invention claimed is:

1. A cap attachment for mounting on a cap having an opening in the rear and one or two straps extending horizontally across the opening, the cap attachment comprising:

a first panel having an outer surface and an inner surface, the first panel having a width slightly greater than the one or two straps and a length at least part way across the one or two straps; and a clip section comprising a connector; and a second panel having an outer surface and an inner surface, the second panel spaced behind the first panel wherein the inner surfaces of the first and second panels face each other, the second panel having about the same width as the first panel and shorter length than the first panel, and centered along the length of the first panel, wherein the connector connects the first panel and the second panel at the top edge of the first panel and defines a gap between the first and second panels, the gap sufficient to permit the one or two straps to nest within the gap, such that when the one or two straps are nested therein, the first and second panels lie on opposite sides of the one or two straps, and wherein the outer surface of the first panel displays a first advertising indicia or decoration and wherein the second panel comprises a second advertising indicia.

2. The cap attachment of claim 1, wherein the first advertising indicia is a logo, image, text, or combination thereof.

3. The cap attachment of claim 1, further comprising a ridge along the bottom edge of the inner surface of the second panel to engage the one or two straps.

4. The cap attachment of claim 3, further comprising a ridge along the left side edge of the inner surface of the first panel, a ridge along the right side edge of the inner surface of the first panel, and a ridge on the bottom edge of the inner surface of the first panel.

5. The cap attachment of claim 4, wherein the ridge on the bottom edge of the inner surface of the first panel is substantially the same length as and opposite to the ridge on the second panel.

6. The cap attachment of claim 1, wherein the first panel is flat and the second panel is curved.

7. The cap attachment of claim 1, wherein the first and second panels are curved and generally parallel.

8. The cap attachment of claim 1, wherein the outer surface of the second panel has an inset area.

9. The cap attachment of claim 8, wherein the inset area is surrounded by a soft or cushion material.

10. The cap attachment of claim 8, wherein the inset area displays a second advertising indicia or decoration.

11. The cap attachment of claim 1, wherein the first and second panels are comprised of a metal.

12. A cap attachment for mounting on a cap having an opening in the rear and one or two straps extending horizontally across the opening, the cap attachment comprising:

a first panel having an outer surface and an inner surface, the first panel having a width slightly greater than the one or two straps and a length at least part way across the one or two straps; and a clip section comprising a connector; and a second panel having an outer surface and an inner surface, the second panel spaced behind the first panel wherein the inner surfaces of the first and second panels face each other, the second panel having about the same width as the first panel and shorter length than the first panel, and centered along the length of the first panel, wherein the connector connects the first panel and the second panel at the top edge of the first panel and defines a gap between the first and second panels, the gap sufficient to permit the one or two straps to nest within the gap, such that when the one or two straps are nested therein, the first and second panels lie on opposite sides of the one or two straps, wherein the outer surface of the first panel displays a first advertising indicia or decoration, and wherein the second panel comprises a second advertising indicia and at least a part of the outer surface of the second panel has a soft or cushion material.

13. The cap attachment of claim 12, wherein the first and second panels are curved and generally parallel.

* * * * *